US011436885B2

(12) United States Patent
Alhazmi

(10) Patent No.: US 11,436,885 B2
(45) Date of Patent: Sep. 6, 2022

(54) IN-VEHICLE INTELLIGENT ACCESS CONTROL SYSTEM AND METHOD

(71) Applicant: Saudi Arabian Oil Company, Dhahran (SA)

(72) Inventor: Hussain Ali Y. Alhazmi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/160,879

(22) Filed: Jan. 28, 2021

(65) Prior Publication Data

US 2022/0237971 A1 Jul. 28, 2022

(51) Int. Cl.
*G07C 9/22* (2020.01)
*G07C 9/27* (2020.01)

(52) U.S. Cl.
CPC ..... *G07C 9/22* (2020.01); *G07C 9/27* (2020.01); *G07C 2209/02* (2013.01)

(58) Field of Classification Search
CPC ..... G07C 9/22; G07C 9/27; G07C 2209/02
See application file for complete search history.

(56) References Cited

U.S. PATENT DOCUMENTS 6,026,340 A 2/2000 Corrado et al.
6,958,676 B1 10/2005 Morgan et al.
8,811,664 B2 8/2014 Dalal et al.
9,202,118 B2 12/2015 Wang et al.
9,963,106 B1 5/2018 Ricci
10,535,208 B2 1/2020 Zavesky et al.
10,810,816 B1 10/2020 Kocher et al.
10,846,809 B2 11/2020 Channah et al.
2005/0110610 A1* 5/2005 Bazakos ..... G07B 15/063 340/5.82
2010/0156630 A1* 6/2010 Ainsbury ..... G07C 9/28 340/540
2016/0117866 A1 4/2016 Stancato et al.
2016/0196706 A1* 7/2016 Tehranchi ..... G07C 9/00174 340/5.61
2017/0052538 A1 2/2017 Li et al.
2020/0238952 A1 7/2020 Lindsay et al.

* cited by examiner

*Primary Examiner* — Nabil H Syed
(74) *Attorney, Agent, or Firm* — Leason Ellis LLP

(57) ABSTRACT

An in-vehicle intelligent access control system and method are configured to automate access of a vehicle to an access point. Prior to approach of the vehicle to the access point, an enrollment system stores, in a database, first data identifying a non-human object in a vehicle, second data identifying the vehicle, third data identifying a human occupant of the vehicle, and fourth data identifying an itinerary of the vehicle. An access control management system receives at least the first data from the database. When the vehicle approaches the access point, the system detects the vehicle within a predetermined range of an access point, receives fifth data transmitted by the vehicle, determines a match of the fifth data with at least the first data within a prescribed tolerance, and controls the access point to allow access of the vehicle to a facility if the fifth data matches at least the first data.

20 Claims, 4 Drawing Sheets

IN-VEHICLE INTELLIGENT ACCESS CONTROL SYSTEM AND METHOD

FIELD OF THE DISCLOSURE

The present disclosure relates generally to automate access points such as security gates, and, more particularly, to an in-vehicle intelligent access control system and method configured to automate access of a vehicle to an access point.

BACKGROUND OF THE DISCLOSURE

Access to facilities can be controlled using manual intervention. For example, a security gate controlling access can be opened or closed to a vehicle based on manual inspection of an identification card, such as a driver's license of the driver of the vehicle. Such manual inspection can be performed by a security guard at the gate who views the identification card and views the driver for subjective matching of the identification card and the driver. Further identification of the vehicle and the contents of the vehicle is often performed by subjective visual matching by a security guard at the gate.

With newly introduced autonomous driving systems, access of a vehicle to an access point can be automated. For example, a driver of a vehicle can insert or swipe an identification card in or near a card reader, such as a card having a magnetic strip or a radio frequency identification (RFID) chip or device. In response to the card reader positively determining the identification card corresponds to a grant of access, a controller of the security gate can respond to the positive determination to automatically grant access to the vehicle. However, such insertion or swiping of the identification card still requires manual activity of the driver. Accordingly, such gate control is only semi-automated.

SUMMARY OF THE DISCLOSURE

According to an embodiment consistent with the present disclosure, an in-vehicle intelligent access control system and method are configured to automatically control access of a vehicle to an access point. Prior to approach of the vehicle to the access point, an enrollment system stores, in a database, first data identifying a non-human object in a vehicle, second data identifying the vehicle, third data identifying a human occupant of the vehicle, and fourth data identifying an itinerary of the vehicle. An access control management system receives at least the first data from the database. When the vehicle approaches the access point, the system detects the vehicle within a predetermined range of an access point, receives fifth data transmitted by the vehicle, determines a match of the fifth data with at least the first data within a prescribed tolerance, and controls the access point to allow access of the vehicle to a facility if the fifth data matches at least the first data.

In an embodiment, a system comprises an enrollment system and an access control management system. The enrollment system has a first processor configured by code executing therein to store, in a database, first data identifying a non-human object in a vehicle, second data identifying the vehicle, third data identifying a human occupant of the vehicle, and fourth data identifying an itinerary of the vehicle. The access control management system has a second processor configured by code executing therein to receive at least the first data from the database, to detect the vehicle entering within a first predetermined range of an access point, to receive fifth data transmitted by the vehicle, to determine a match of the fifth data with at least the first data within a prescribed tolerance, and to automate the access point to allow access of the vehicle to a facility if the fifth data matches at least the first data.

The access control management system determines the match when the vehicle is within a second predetermined distance of the access point, with the second predetermined distance being less than the first predetermined distance. The access control management system is operatively connected to the database by a network, and the access control management system receives at least the first data from the database through the network. The vehicle includes a sensor configured to detect an identification corresponding to at least one of the first data, second data, third data, and fourth data. The sensor detects the identification selected from the group consisting of: identification of the non-human object, identification of the vehicle, identification of the human occupant, and identification of a current time and a current location of the vehicle. The sensor is selected from the group consisting of: a bar code reader, a thermal sensor, an ultrasonic sensor, an optical sensor, a card reader, a biometric scanner, an electronic scanner configured to communicate with a smartphone, a clock, a global positioning device, an accelerometer, a gyroscope, and a magnetometer. The sensor is disposed on the vehicle. Alternatively, the sensor is disposed within the interior of the vehicle.

In another embodiment, a system is configured to automate access of a vehicle to a facility. The system includes a network, a database, an enrollment system, and an access control management system. The enrollment system is operatively connected to the database through the network, wherein the enrollment system has a first processor configured by code executing therein to store, in the database, first data identifying a non-human object in the vehicle, second data identifying the vehicle, third data identifying a human occupant of the vehicle, and fourth data identifying an itinerary of the vehicle. The access control management system operatively connected to the database through the network, wherein the access control management system has a second processor configured by code executing therein to receive at least the first data from the database, to detect the vehicle entering within a first predetermined range of an access point, to receive fifth data transmitted by the vehicle, to determine a match of the fifth data with at least the first data within a prescribed tolerance, and to automate the access point to allow access of the vehicle to the facility if the fifth data matches at least the first data.

An output device is configured to output an error message if the fifth data does not match at least the first data. The access control management system receives at least the first data from the database through the network when the vehicle is within a first predetermined distance from the access point. The vehicle includes a sensor configured to detect an identification corresponding to at least one of the first data, second data, third data, and fourth data. The sensor detects the identification selected from the group consisting of: identification of the non-human object, identification of the vehicle, identification of the human occupant, and identification of a current time and a current location of the vehicle. The sensor is selected from the group consisting of: a bar code reader, a thermal sensor, an ultrasonic sensor, an optical sensor, a card reader, a biometric scanner, an electronic scanner configured to communicate with a smartphone, a clock, a global positioning device, an accelerometer, a gyroscope, and a magnetometer. The sensor is disposed on the vehicle. Alternatively, the sensor is disposed within the interior of the vehicle. The access control management system determines the match when the vehicle is within a second predetermined distance of the access point, with the second predetermined distance being less than the first predetermined distance.

In a further embodiment, a method comprises storing, in a database, first data identifying a non-human object in a vehicle, second data identifying the vehicle, third data identifying a human occupant of the vehicle, and fourth data identifying an itinerary of the vehicle; detecting the vehicle entering within a first predetermined range of an access point; receiving fifth data transmitted by the vehicle; determining whether a match of the fifth data with at least the first data within a prescribed tolerance exists; and controlling the access point to allow access of the vehicle to a facility if the fifth data matches at least the first data.

The method further includes outputting an error message from an output device if the fifth data does not match at least the first data. The vehicle includes a sensor configured to detect an identification corresponding to at least one of the first data, second data, third data, and fourth data, wherein the identification is selected from the group consisting of: identification of the non-human object, identification of the vehicle, identification of the human occupant, and identification of a current time and a current location of the vehicle.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to an in-vehicle intelligent access control system and method are configured to automate access of a vehicle to an access point.

Figure 1:
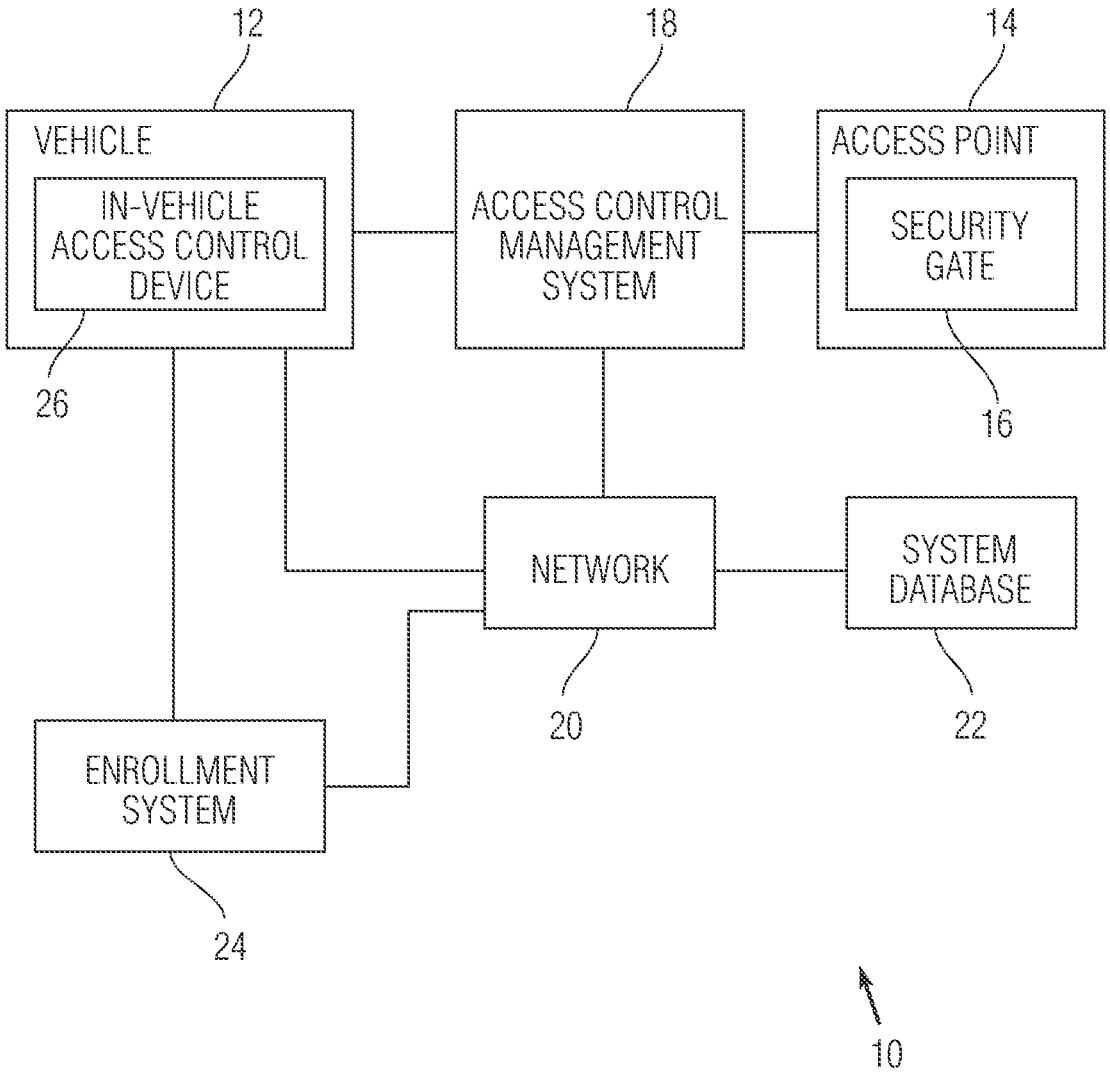
FIG. 1 illustrates a schematic diagram of the system, according to an embodiment.
Figure 2:
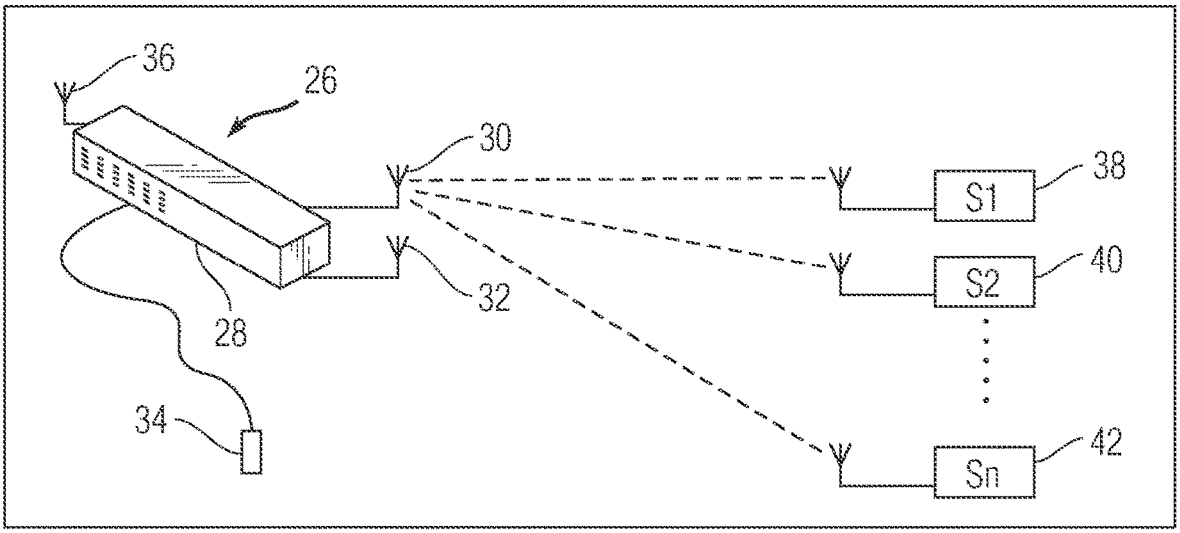
FIG. 2 illustrates an in-vehicle intelligent device used by the system of FIG. 1.
Figure 3:
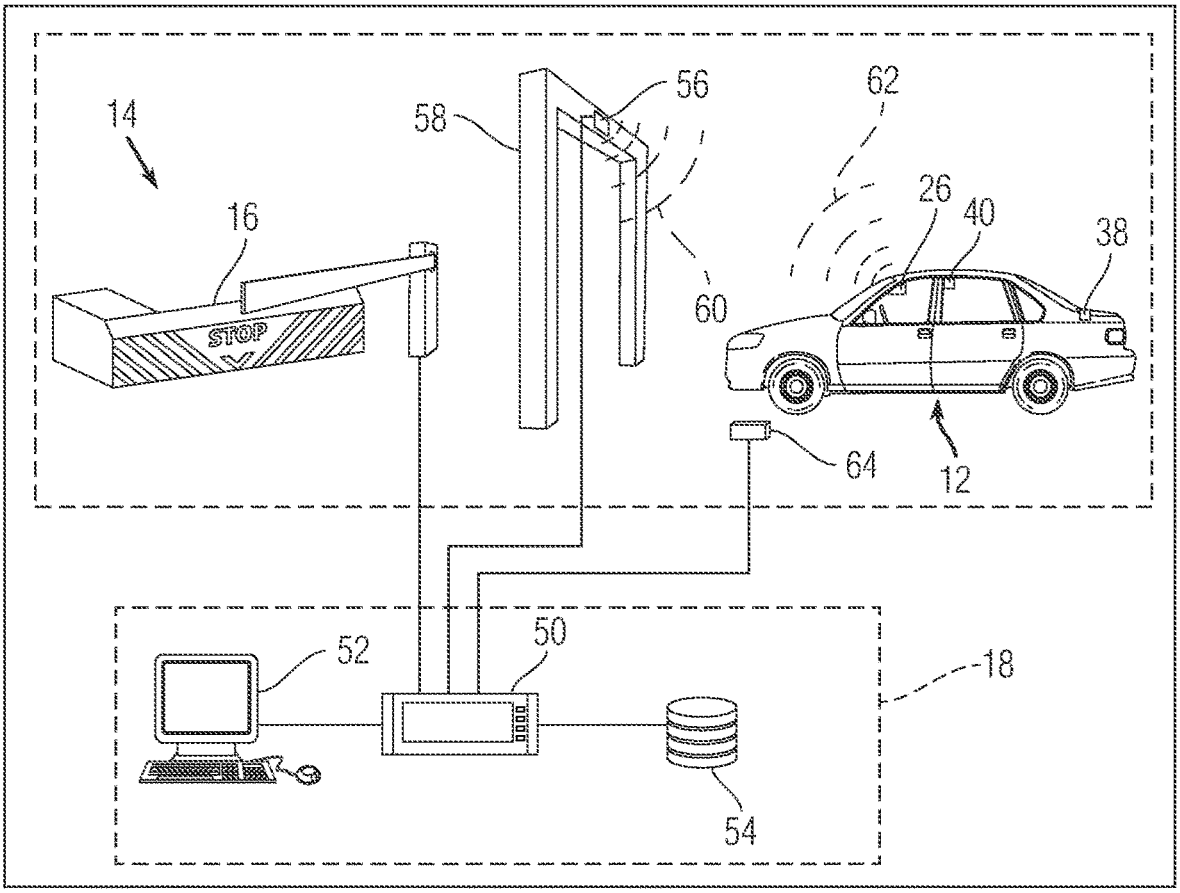
FIG. 3 illustrates a portion of the system of FIG. 1 in greater details.

As shown in FIGS. 1-5, the in-vehicle intelligent access control system 10 and method 100 are configured to automatically control access of a vehicle 12 to an access point 14. Referring to FIGS. 1 and 3, the access point 14 can be a security gate 16 to allow or prevent entry of the vehicle 12 to a facility. The system 10 includes an access control management system 18 operatively connected to the vehicle 12, to the access point 14, and to a network 20. Alternatively, the access control management system 18 can be operatively connected to the vehicle 12 and the access point 14 through the network 20. In addition, through the network 20, the access control management system 18 can be operatively connected to a system database 22 and to an enrollment system 24. The network 20 can be the Internet. Alternatively, the network 20 can be a wide area network (WAN). In addition, the network 20 can be any known communications system configured to interconnect the various components 12, 14, 16, 18, 22, 24 as described herein.

As described in greater detail below, an in-vehicle intelligent access control device 26 is disposed within the vehicle 12. The in-vehicle intelligent access control device 26 has a processor 46 configured by code provided from a memory 48 which is executing in the processor to receive data from at least one sensor in real-time. The received data includes first data identifying a non-human object in the vehicle 12, second data identifying the vehicle 12, third data identifying a human occupant of the vehicle 12, and fourth data identifying an itinerary of the vehicle 12. The non-human objects identified by the first data can be items contained in the vehicle 12. The non-human objects can also be items loaded upon the vehicle 12. The non-human objects can also be goods. In addition, the non-human objects can be living animals. Alternatively, the non-human objects can be living plants.

The identification of the vehicle 12 by the second data can be a vehicle identification number (VIN). The identification of the vehicle 12 can also include a vehicle plate number. The identification of the vehicle 12 can also include a city, state, province, or country identifier, such as "SA" for Saudi Arabia. The identification of the vehicle 12 can comply with the ISO 3166-1 standard for countries and their subdivisions. The identification of the vehicle 12 can also include the make of the vehicle 12. The identification of the vehicle 12 can also include the model of the vehicle 12. The identification of the vehicle 12 can also include the year of manufacture associated with the vehicle 12. The identification of the vehicle 12 can also include a bar code placed on the vehicle 12. The bar code can be uniquely associated with the vehicle 12. Each data comprising the identification of the vehicle is storable in the database 22 or another storage device which can communicate with the processor of the in-vehicle intelligent access control device 26.

The human occupant of the vehicle 12 identified by the third data can be a driver of the vehicle 12. The human occupant of the vehicle 12 can also be a passenger of the vehicle 12. The human occupant can be associated with a name of the occupant. The name of the occupant can be based on an identification document of the occupant, such as a driver's license. The identification document can also be a passport of the occupant. The third data can also be a value as the count of the number of occupants of the vehicle 12. The human occupant can also be associated with biometric data of the occupant. The biometric data can be a fingerprint of the occupant. The biometric data can also be the face of the occupant. The biometric data can also be any identifier uniquely associated with the occupant, such as a retinal scan. The biometric data can be verified using fingerprint analysis, facial recognition, and other biometric verification methods as described below using conventional devices for obtaining such data from the occupant which devices are available to provide inputs to the in-vehicle intelligent access control device 26.

The itinerary of the vehicle 12 identified by the fourth data can include a location of the vehicle 12. The location of the vehicle 12 can include Global Positioning System (GPS) coordinates of the destination of the vehicle 12, such as the geographic location of the access point 14. The itinerary of the vehicle 12 can also include a time of the vehicle 12, such as a projected time of the vehicle 12 in a specified time zone. The itinerary of the vehicle 12 can also include a date of the vehicle 12, such as a projected date of the vehicle 12 in a specified time zone. The itinerary of the vehicle 12 can also include combinations of the location, time, and date associated with geographic travel of the vehicle 12. The fourth data is storable in the database 22 or another storage device which can communicate with the processor of the in-vehicle intelligent access control device 26.

Referring again to FIG. 1, the in-vehicle intelligent access control device 26 can be operatively connected directly to the enrollment system 24 which comprises code executing in one or more processors to perform the functions described herein. Alternatively, the in-vehicle intelligent access control device 26 can be operatively connected to the enrollment system 24 through the network 20. Accordingly, the in-vehicle intelligent access control device 26 can provide or otherwise generate data corresponding to the first data identifying a non-human object in the vehicle 12, the second data identifying the vehicle 12, the third data identifying a human occupant of the vehicle 12, and the fourth data identifying an itinerary of the vehicle 12.

In an alternative embodiment, the enrollment system 24 receives as inputs any one of the first, second, third, and fourth data from a third-party, such as a vehicle loading service. The vehicle loading service can load the vehicle with objects and occupants. The vehicle loading service can also associate a value as the count of the number of objects. The vehicle loading service can also associate a value as the count of the number of occupants. The vehicle loading service can also associate the vehicle and its identification information with the objects and occupants. The vehicle loading service can also associate the vehicle, objects, and occupants with an itinerary of the vehicle. Each of the associations can be stored in the database 22 or in another data storage device.

The third-party can also be a vehicle dispatching service. The vehicle dispatching service can check the vehicle and its objects and occupants at any point on the itinerary of the vehicle, using signals provided by the sensors and readers included in the device 26 as described further below. The vehicle dispatching service can also associate the vehicle and its identification information with the objects and occupants. The vehicle dispatching service can also associate a value as the count of the number of objects. The vehicle dispatching service can also associate a value as the count of the number of occupants. The vehicle dispatching service can also associate the vehicle, objects, and occupants with the itinerary of the vehicle. Each of the associations can be stored in the database 22 or in another data storage device.

The enrollment system 24 has a processor configured by code executing therein to store, in the database 22, first data identifying a non-human object in the vehicle 12, second data identifying the vehicle 12, third data identifying a human occupant of the vehicle 12, and fourth data identifying an itinerary of the vehicle 12. The database 22 can be an SQL database configured to store data in the SQL format. Alternatively, the database 22 can store data in any known format. For example, the first data identifying a non-human object in the vehicle 12 can list the non-human objects as text entries. In another example, the second data identifying the vehicle 12 can list the vehicle identifiers as a record or a collection of text entries, such as the make, model, and year of manufacture associated with the vehicle 12. In a further example, the third data identifying a human occupant of the vehicle 12 can include a set of data points associated with fingerprint analysis, facial recognition, retinal analysis, or other biometric data formats. In another example, the fourth data identifying an itinerary of the vehicle 12 can list the itinerary as a record or a collection of text entries, such as the time, data, and location of the vehicle 12 as the vehicle travels geographically.

The access control management system 18 has a processor configured by code executing therein to receive at least the first data from the database 22, to detect the vehicle 12 entering within a first predetermined range of the access point 14, to receive fifth data transmitted by the vehicle 12, to determine a match of the fifth data with at least the first data within a prescribed tolerance, and to automate the access point 14 to allow access of the vehicle 12 to a facility if the fifth data matches at least the first data. The prescribed tolerance for determining a match can include a criterion depending upon the type of data being compared. For example, the first data identifying a non-human object in the vehicle 12 can include a number of containers storing goods, a number of living animals, or a number of living plants without necessarily specifying the contents of the containers, or the types of living animals or plants. If the container, animal, or plant numbers in the first data are, for example and not by way of limitation of an acceptable tolerance, within plus one or minus one of the numbers in the fifth data, then a match can be established.

In another example, the second data identifying the vehicle 12 can include the year of manufacture of the vehicle. If the year numbers in the second data are, for example, match exactly—that is, with no tolerance permitted for that data point as compared to the fifth data, then a match can be established. In a further example, the third data identifying a human occupant of the vehicle 12 can include twenty points of fingerprint identification points, such as ridges and whorls. If the number of fingerprint identification points in the third data are, for example, matching at least sixteen points in the fifth data, then a match can be established. In another example, the third data identifying a human occupant of the vehicle 12 can include a thermal scan from which a count of human shapes is automatically performed by thermal image recognition techniques. If the count of human shapes is within zero or minus one of the numbers in the fifth data, then a match can be established. In still further an example, the fourth data identifying an itinerary of the vehicle 12 can include a time, date, and location of the vehicle 12. If the numbers in the fourth data are, for example, within plus one hour or minus one hour of the time in the fifth data, or within plus one day or minus one day of the date in the fifth data, or within ten miles from the location in the fifth data, then a match can be established.

The access control management system 18 determines the match, within the prescribed tolerance, when the vehicle 12 is within a second predetermined distance of the access point 14, with the second predetermined distance being less than the first predetermined distance. The access control management system 18 receives at least the first data from the database 22 through the network 20. As shown in FIG. 3, the access control management system 18 includes a controller 50 as the processor, and an output device 52 configured to output an error message if the fifth data does not match at least the first data within the established tolerance for that data point. The access control management system 18 can also include a database server 54. The database server 54 stores enrollment data, such as the first, second, third, and fourth data, from the enrollment system 24. The database server 54 can include the system database 22.

The vehicle 12 includes at least one sensor configured to detect an identification corresponding to at least one of the first data, second data, third data, and fourth data. As shown in FIG. 2, the at least one sensor is disposed on the vehicle 12. Alternatively, the sensor is disposed within the interior of the vehicle 12. The sensor detects the identification selected from the group consisting of: identification of the non-human object, identification of the vehicle, identification of the human occupant, and identification of a current time and a current location of the vehicle. The sensor is selected from the group consisting of: a bar code reader, a thermal sensor, an ultrasonic sensor, an optical sensor, a card reader, a biometric scanner, an electronic scanner configured to communicate with a smartphone, a clock, a global positioning device, an accelerometer, a gyroscope, and a magnetometer.

Referring to FIGS. 2-3, the at least one sensor is included within the in-vehicle intelligent access control device 26. Alternatively or in addition, the at least one sensor can include sensors 38, 40, 42, labeled S1, S2, . . . Sn, respectively. As shown in FIG. 2, the at least one of the sensors 38, 40, 42 can communicate with the in-vehicle intelligent access control device 26 using wireless signals. For example, the at least one sensor 38, 40, 42 and the in-vehicle intelligent access control device 26 can include antennae configured to transmit and receive, respectively, the wireless signals. The wireless signals can be radio waves complying with any known communication protocol. For example, the wireless signals can be WIFI signals. Alternatively, the wireless signals can be infrared signals. In a further embodiment, the at least one sensor 38, 40, 42 can be connected by a respective cable to the in-vehicle intelligent access control device 26 and configured to communicate using wired communications. For example, the cable can be a coaxial cable. The at least one sensor 38, 40, 42 and the in-vehicle intelligent access control device 26 can have connectors such as jacks configured to be connected to a cable. By wireless or wired communications, the at least one sensor 38, 40, 42 transmits signals representing sensor data to the in-vehicle intelligent access control device 26.

As described above, the at least one sensor includes a card reader 28 having a slot configured to receive an identification card associated with the vehicle 12. For example, the identification card can be a vehicle registration card. Alternatively, the identification card can be associated with an occupant of the vehicle 12, such as a driver's license or a passport. The at least one sensor can also include an antenna 30 operatively connected to at least one of the sensors 30, 40, 42. The sensor 38 can be an ultrasonic sensor configured to emit ultrasonic waves in the interior of the vehicle 12. Reflections of the ultrasonic waves can be detected by the sensor 38 and used by the in-vehicle intelligent access control device 26 to count the number of non-human objects in the vehicle 12. Alternatively, reflections of the ultrasonic waves can be detected by the sensor 38 and used by the in-vehicle intelligent access control device 26 to count the number of occupants in the vehicle 12. The sensor 40 can be a thermal sensor configured to detect heat in the interior of the vehicle 12. The heat detected by the sensor 40 can be used by the in-vehicle intelligent access control device 26 to count the number of occupants in the vehicle 12. The sensor 42 can be any other type of sensor configured to detect the occupants of the vehicle 12. For example, the sensor 42 can be an optical sensor such as a camera configured to generate an image of the occupants. Based on the image, the in-vehicle intelligent access control device 26 can recognize the shapes of people to count the number of occupants in the vehicle 12. Alternatively, the in-vehicle intelligent access control device 26 can perform facial recognition of the occupants based on the image. Using such facial recognition, the in-vehicle intelligent access control device 26 can perform biometric verification of the occupants, including the driver of the vehicle 12.

The in-vehicle intelligent access control device 26 can also include an antenna 32 connected to a geographic locating system configured to perform geographic location of the vehicle 12 using the Global Positioning System (GPS) or any other known geographic locating system, such as GLONASS, BEIDOU, and GALILEO. The in-vehicle intelligent access control device 26 can also include a biometric sensor 34, such as a fingerprint scanner, configured to detect a unique physical property of an occupant of the vehicle 12. For example, each occupant of the vehicle 12 can insert a finger into the biometric sensor 34 to be scanned and processed by the in-vehicle intelligent access control device 26 to identify each respective occupant.

As shown in FIG. 2, the in-vehicle intelligent access control device 26 can also include an antenna 36 connected to a WIFI sensor configured to communicate with a WIFI signal generator 56 mounted on a physical structure 58, as shown in FIG. 3. Signals 60 formatted in the WIFI or IEEE 802.11P/n communication protocol are transmitted by the WIFI signal generator 56. When the vehicle 12 approaches the structure 58, the antenna 36 receives the WIFI signals 60. The in-vehicle intelligent access control device 26, using its processor configured by code executing therein, responds to the detected WIFI signals 60 to gather the first, second, third, and fourth data from the vehicle 12, its occupants, and its non-human objects. The gathered data from the vehicle 12 can be transmitted in the form of signals 62 received and processed by the access control management system 18 to grant or deny access of the vehicle 12 through the security gate 16.

Other sensors can be included in the in-vehicle intelligent access control device 26. Alternatively, the other sensors can be in communication with the in-vehicle intelligent access control device 26, such as by a wired or wireless connection. The other sensors can include a bar code reader configured to read a bar code. The bar code can be on a label placed on an object in or on the vehicle 12, with the bar code identifying the object, such as its nature, contents, point of origin, etc. Alternatively, the bar code can be on a label placed on or in the vehicle 12, with the bar code identifying the vehicle 12, such as the make, model, license plate, year of manufacture, etc. of the vehicle 12. In addition, the bar code can be on a card associated with an occupant of the vehicle 12, such as a card in the form of a driver's license, a passport, an identification (ID) card, etc.

Another sensor can be an electronic scanner configured to communicate with a smartphone using a known communication protocol, such as BLUETOOTH. The smartphone can be associated with an occupant of the vehicle 12. The smartphone can include a display for displaying a bar code such as a quick response (QR) code, with the bar code identifying the occupant of the vehicle 12. Alternatively, the smartphone can emit an identification signal to identify the occupant associated with the smartphone. Accordingly, the electronic scanner can acquire identification information from the smartphone to identify an occupant of the vehicle 12.

In addition, another sensor can include a clock configured to track the time, date, and time zone associated with the vehicle 12, in order to identify the temporal location of the vehicle 12 in relation to a previously stored itinerary. Another set of sensors can include one or more of an accelerometer, a gyroscope, and a magnetometer configured to track the speed, direction, and orientation of the vehicle 12, in order to identify the spatial or geographic location of the vehicle 12 in relation to the previously stored itinerary.

Figure 4:
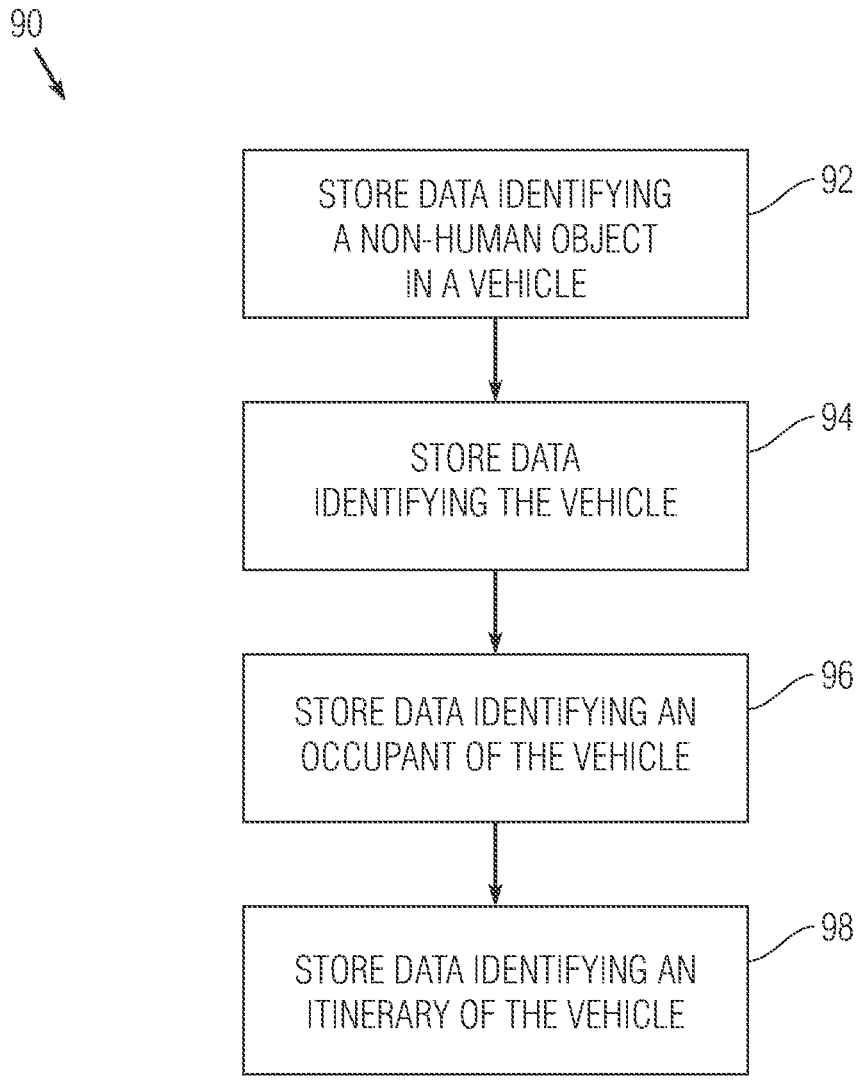
FIG. 4 illustrates a flowchart of an enrollment method.

Referring to FIG. 4, a method 90 is performed to enroll or pre-register a vehicle 12, its human occupants, its non-human objects, and its itinerary. The method 90 includes the step 92 of storing, in the system database 22, first data identifying a non-human object in the vehicle 12. Then the method 90 includes the step 94 of storing, in the system database 22, second data identifying the vehicle 12. The method 90 also includes the step 96 of storing, in the system database 22, third data identifying a human occupant of the vehicle 12. The method 90 further includes the step 98 of storing, in the system database 22, fourth data identifying an itinerary of the vehicle 12.

Figure 5:
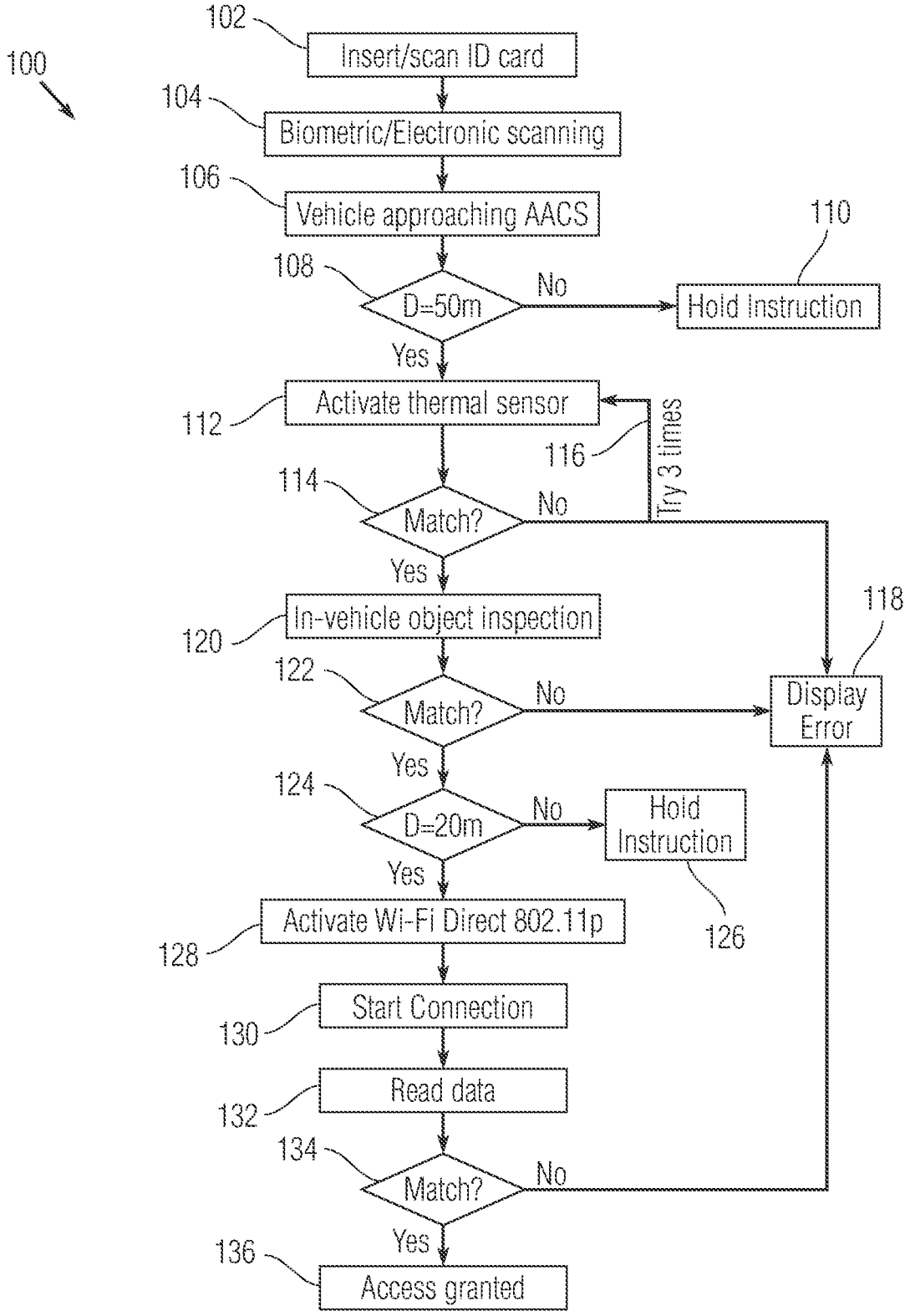
FIG. 5 illustrates a flowchart of a method of operation of the system of FIG. 1.

Referring to FIG. 5, a method 100 is performed to automatically grant or deny access of the vehicle 12 to the access point 14. Such granted access can include opening or raising the security gate 16 at the access point 14. The granted access can also include marking the vehicle 12 to travel into the facility beyond the access point 14. In step 102, at least one occupant of the vehicle 12, such as the driver, inserts or scans an ID card with a corresponding card reader or scanner included or in communication with the in-vehicle intelligent access control device 26, as described above. In step 104, the at least one occupant of the vehicle 12 performs biometric or electronic scanning of the at least one occupant, as described above. Then in step 106, the vehicle 12 approaches the access control management system 18, which is an automated access control system (AACS). The access control management system 18 can detect the approach of the vehicle 12 when the vehicle 12 is within a detection range of a vehicle sensing device. The vehicle sensing device can be a magnetometer 64, as shown in FIG. 3.

The access control management system 18 can determine if the vehicle 12 is at a first predetermined distance from the access point 14, such as the security gate 16, as shown in FIGS. 1 and 3. The first predetermined distance can be, for example, 50 m. In step 108, if the distance D of the vehicle 12 from the access point 14 is not the first predetermined distance, the method 100 has the access control management system 18, in step 110, send a hold instruction to the controller 50 to deny access of the vehicle 12 to the access point 14. Otherwise, once the vehicle 12 is at the first predetermined distance in step 108, the access control management system 18 instructs the vehicle 12 to activate a thermal sensor 38 in step 112. The thermal sensor 38 generates a thermal image of the at least one occupant of the vehicle 12. The in-vehicle intelligent access control device 12 can send the thermal image to the access control management system 18. Using the thermal image and predetermined image recognition software, the access control management system 18 can generate an actual count of the number of occupants in the vehicle 12.

In step 114, if the actual count of the occupants does not match the count of the number of occupants listed by the enrollment system 24 in the database 22, the method 100 can try a predetermined number of times in step 116 to activate the thermal sensor 38 to count the occupants of the vehicle 12. The predetermined number of times in step 116 can be three times. The predetermined number of times can be default to three times. The predetermined number of times can be set by a system administrator of the access control management system 18. In step 114, if the actual count of the occupants does not match the count of the number of occupants listed by the enrollment system 24 in the database 22 after the predetermined number of times, the method 100 proceeds to step 118 to output an error message. The outputted error message can be displayed on the display 52 to the system operator of the access control management system 18. Alternatively, the outputted error message can be sent to the vehicle 12 using the WIFI signals 60. The outputted error message can then be conveyed to at least one occupant of the vehicle 12. The at least one occupant can be the driver of the vehicle 12. The outputted error message can be an audio message generated through a sound speaker of the vehicle 12 to be heard by the at least one occupant. The audio message can indicate that the count of occupants does not match the count in the database 22 previously stored by the enrollment system 24. The audio message can also indicate that access of the vehicle 12 is denied due to the mismatch of the number of occupants in the vehicle 12 compared to the enrolled or pre-registered number previously stored in the database 22. The outputted error message can be a visual message on a display in the vehicle 12.

However, in step 114, if there is a match of the count of the number of occupants in the vehicle 12, within the prescribed tolerance described above, then the method 100 proceeds to step 120. In step 120, an in-vehicle object inspection is performed. For example, an occupant of the vehicle 12 can use a bar code scanner to scan bar codes on non-human objects in the vehicle 12. The bar codes can be on a container of goods or living plants. The bar codes can also be on a container such as a cage for living animals.

In step 122, if the actual count of the non-human objects does not match the count of the number of non-human objects listed by the enrollment system 24 in the database 22, the method 100 proceeds to step 118 to output an error message. The outputted error message can be displayed on the display 52 to the system operator of the access control management system 18. Alternatively, the outputted error message can be sent to the vehicle 12 using the WIFI signals 60. The outputted error message can then be conveyed to at least one occupant of the vehicle 12. The at least one occupant can be the driver of the vehicle 12. The outputted error message can be an audio message generated through a sound speaker of the vehicle 12 to be heard by the at least one occupant. The audio message can indicate that the count of non-human objects does not match the count in the database 22 previously stored by the enrollment system 24. The audio message can also indicate that access of the vehicle 12 is denied due to the mismatch of the number of non-human objects in the vehicle 12 compared to the enrolled or pre-registered number previously stored in the database 22. The outputted error message can be a visual message on a display in the vehicle 12.

However, in step 122, if there is a match of the count of the number of non-human objects in the vehicle 12, within the prescribed tolerance described above, then the method 100 proceeds to step 124. In step 124, the method 100 checks whether the distance D of the vehicle 12 from the access point 14 is at a second predetermined distance less than the first predetermined distance. For example, the second predetermined distance can be 20 m. If the distance D is not the second predetermined distance, then the method 100 has the access control management system 18, in step 126, send a hold instruction to the controller 50 to continue to deny access to the access point 14 of the vehicle 12. Otherwise, once the vehicle 12 is at the second predetermined distance in step 124, the access control management system 18 instructs the structure 58 to activate and transmit the WIFI signals 60 in step 128. The WIFI signals can comply with the WIFI Direct, IEEE 802.11p standard.

The access control management system 18 starts a connection with the vehicle 12 in step 130 using the transmitted signals 60, 62. In particular, a connection for data transfer is established between the in-vehicle intelligent access control device 26 and the access control management system 18. After the connection is established in step 130, the access control management system 18 reads the fifth data gathered and transmitted from the in-vehicle intelligent access control device 26 in step 132. The fifth data can be gathered in response to the establishment of the connection in step 130. Alternatively, the fifth data can be gathered by the in-vehicle intelligent access control device 26 and stored in a memory of the in-vehicle intelligent access control device 26 for later retrieval and transmission from the in-vehicle intelligent access control device 26 to the access control management system 18. The access control management system 18 then determines if the fifth data matches at least the first data within a prescribed tolerance in step 134, as described above. Alternatively or in addition, the management system 18 determines if the fifth data matches the first data, the second data, the third data, and the fourth data, each within a prescribed tolerance, as described above.

In step 134, if any of the fifth data does not match, within a prescribed tolerance described above, the first data, second data, third data, and fourth data listed by the enrollment system 24 in the database 22, the method 100 proceeds to step 118 to output an error message. The outputted error message can be displayed on the display 52 to the system operator of the access control management system 18. Alternatively, the outputted error message can be sent to the vehicle 12 using the WIFI signals 60. The outputted error message can then be conveyed to at least one occupant of the vehicle 12. The at least one occupant can be the driver of the vehicle 12. The outputted error message can be an audio message generated through a sound speaker of the vehicle 12 to be heard by the at least one occupant. The audio message can indicate that the situation in the vehicle 12, corresponding to non-human objects in a vehicle 12, the identification of the vehicle 12, the human occupants of the vehicle 12, and the itinerary of the vehicle 12 does not match the corresponding data, respectively, in the database 22 previously stored by the enrollment system 24. The audio message can also indicate that access of the vehicle 12 is denied due to the mismatch of the situation in the vehicle 12 compared to the enrolled or pre-registered number previously stored in the database 22. The outputted error message can be a visual message on a display in the vehicle 12.

However, in step 134, if there is a match of the fifth data with all of the first data, second data, third data, and fourth data, within the respective prescribed tolerances of each type of data, as described above, then access is granted automatically in real-time to the vehicle 12 in step 136. For example, access is granted if the actual number of non-human objects in the vehicle 12 matches the number of non-human objects previously stored in the database 22, if the actual identity of the vehicle 12 matches the identification of the vehicle 12 previously stored in the database 22, if the actual number of occupants in the vehicle 12 matches the number of occupants previously stored in the database 22, and if the actual time and date of arrival of the vehicle 12 at the access point 14 matches the time and date of arrival according to an itinerary previously stored in the database 22.

Such granted access can include opening or raising the security gate 16 at the access point 14. The granted access can also include marking the vehicle 12 to travel into the facility beyond the access point 14. The marking of the vehicle 12 can be electronic such that the vehicle 12 is recognized as having access throughout the facility. Alternatively, the marking of the vehicle 12 can include affixing a bar code to the vehicle 12 indicating that the vehicle 12 is recognized as having access throughout the facility.

Portions of the methods described herein can be performed by software or firmware in machine readable form on a tangible (e.g., non-transitory) storage medium. For example, the software or firmware can be in the form of a computer program including computer program code adapted to cause the in-vehicle intelligent access control system and method to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A system, comprising:

an enrollment system having a first processor configured by code executing therein to receive, from a vehicle dispatching service, first data identifying a non-human object in a vehicle, second data identifying the vehicle, third data identifying a human occupant of the vehicle, and fourth data identifying an itinerary of the vehicle, and to store the first, second, third, and fourth data in a database;

a plurality of sensors configured to sense current data corresponding to the non-human object, the human occupant, and the vehicle at any point on the itinerary of the vehicle;

an in-vehicle intelligent access control device configured to receive the sensed current data from the plurality of sensors; and an access control management system having a second processor configured by code executing therein to receive, from the in-vehicle intelligent access control device, the current data corresponding to the non-human object, the human occupant, and the vehicle at any point on the itinerary of the vehicle, to receive the first, second, third, and fourth data from the database, to detect the vehicle entering within a first predetermined range of an access point, to receive fifth data among the current data transmitted by the in-vehicle intelligent access control device, to determine a match of the fifth data with the first, second, third, and fourth data within a prescribed tolerance, and to automate the access point to allow access of the vehicle to a facility if the fifth data matches the first, second, third, and fourth data.

2. The system of claim 1, wherein the access control management system determines the match when the vehicle is within a second predetermined distance of the access point, with the second predetermined distance being less than the first predetermined distance.

3. The system of claim 1, wherein the access control management system is operatively connected to the database by a network, and wherein the access control management system receives the first, second, third, and fourth data from the database through the network.

4. The system of claim 1, wherein the vehicle includes the plurality of sensors configured to detect an identification corresponding to at least one of the first data, second data, third data, and fourth data.

5. The system of claim 4, wherein the plurality of sensors detect the identification selected from the group consisting of: identification of the non-human object, identification of the vehicle, identification of the human occupant, and identification of a current time and a current location of the vehicle.

6. The system of claim 4, wherein the plurality of sensors are selected from the group consisting of: a bar code reader, a thermal sensor, an ultrasonic sensor, an optical sensor, a card reader, a biometric scanner, an electronic scanner configured to communicate with a smartphone, a clock, a global positioning device, an accelerometer, a gyroscope, and a magnetometer.

7. The system of claim 4, wherein the plurality of sensors are disposed on the vehicle.

8. The system of claim 4, wherein the plurality of sensors are disposed within the interior of the vehicle.

9. A system configured to automate access of a vehicle to a facility, comprising:

a network;

a database;

an enrollment system operatively connected to the database and to a vehicle dispatching service through the network, wherein the enrollment system has a first processor configured by code executing therein to receive, from the vehicle dispatching service, first data identifying a non-human object in the vehicle, second data identifying the vehicle, third data identifying a human occupant of the vehicle, and fourth data identifying an itinerary of the vehicle, and to store the first, second, third, and fourth data in the database;

a plurality of sensors configured to sense current data corresponding to the non-human object, the human occupant, and the vehicle at any point on the itinerary of the vehicle;

an in-vehicle intelligent access control device configured to receive the sensed current data from the plurality of sensors; and an access control management system operatively connected to the database through the network, wherein the access control management system has a second processor configured by code executing therein to receive, from the in-vehicle intelligent access control device, the current data corresponding to the non-human object, the human occupant, and the vehicle at any point on the itinerary of the vehicle, to receive the first, second, third, and fourth data from the database, to detect the vehicle entering within a first predetermined range of an access point, to receive fifth data among the current data transmitted by the in-vehicle intelligent access control device, to determine a match of the fifth data with the first, second, third, and fourth data within a prescribed tolerance, and to automate the access point to allow access of the vehicle to the facility if the fifth data matches the first, second, third, and fourth data.

10. The system of claim 9, further comprising:

an output device configured to output an error message if the fifth data does not match the first, second, third, and fourth data.

11. The system of claim 9, wherein the access control management system receives the first, second, third, and fourth data from the database through the network when the vehicle is within a first predetermined distance from the access point.

12. The system of claim 9, wherein the vehicle includes the plurality of sensors configured to detect an identification corresponding to at least one of the first data, second data, third data, and fourth data.

13. The system of claim 12, wherein the plurality of sensors detect the identification selected from the group consisting of: identification of the non-human object, identification of the vehicle, identification of the human occupant, and identification of a current time and a current location of the vehicle.

14. The system of claim 12, wherein the plurality of sensors are selected from the group consisting of: a bar code reader, a thermal sensor, an ultrasonic sensor, an optical sensor, a card reader, a biometric scanner, an electronic scanner configured to communicate with a smartphone, a clock, a global positioning device, an accelerometer, a gyroscope, and a magnetometer.

15. The system of claim 12, wherein the plurality of sensors are disposed on the vehicle.

16. The system of claim 12, wherein the plurality of sensors are disposed within the interior of the vehicle.

17. The system of claim 9, wherein the access control management system determines the match when the vehicle is within a second predetermined distance of the access point, with the second predetermined distance being less than the first predetermined distance.

18. A method, comprising:

receiving, at an enrollment system from a vehicle dispatching service, first data identifying a non-human object in a vehicle, second data identifying the vehicle, third data identifying a human occupant of the vehicle, and fourth data identifying an itinerary of the vehicle;

storing the first, second, third, and fourth data in a database;

sensing, using a plurality of sensors, current data corresponding to the non-human object, the human occupant, and the vehicle at any point on the itinerary of the vehicle;

transmitting the current data from the plurality of sensors;

receiving, at an in-vehicle intelligent access control device, the sensed current data from the plurality of sensors;

transmitting, from the in-vehicle intelligent access control device, the sensed current data;

receiving, at an access control management system from the in-vehicle intelligent access control device, the current data corresponding to the non-human object, the human occupant, and the vehicle at any point on the itinerary of the vehicle;

receiving, at the access control management system from the database, the first, second, third, and fourth data;

detecting the vehicle entering within a first predetermined range of an access point;

receiving fifth data among the current data transmitted by the in-vehicle intelligent access control device;

determining whether a match of the fifth data with the first, second, third, and fourth data within a prescribed tolerance exists; and controlling the access point to allow access of the vehicle to a facility if the fifth data matches the first, second, third, and fourth data.

19. The method of claim 18, further comprising:

outputting an error message from an output device if the fifth data does not match the first, second, third, and fourth data.

20. The method of claim 18, wherein the vehicle includes the plurality of sensors configured to detect an identification corresponding to at least one of the first data, second data, third data, and fourth data, wherein the identification is selected from the group consisting of: identification of the non-human object, identification of the vehicle, identification of the human occupant, and identification of a current time and a current location of the vehicle.

* * * * *